United States Patent [19]

Barr

[11] 3,989,257

[45] Nov. 2, 1976

[54] GOLF PUTTER

[76] Inventor: Samuel J. Barr, 1855 Medical Drive, Titusville, Fla. 32780

[22] Filed: Sept. 2, 1975

[21] Appl. No.: 609,289

[52] U.S. Cl. ..... 273/175; 273/80 C; 273/164; 273/167 G; 273/167 J

[51] Int. Cl.[2] ..... A63B 53/04

[58] Field of Search ..... 273/77 R, 78, 79, 80 C, 273/164, 167–175; D34/5 GC, 5 GH

[56] References Cited

UNITED STATES PATENTS

| | | | |
|---|---|---|---|
| 792,631 | 6/1905 | Taylor | 273/164 |
| 1,511,479 | 10/1924 | Kelly et al. | 273/175 |
| 2,023,885 | 12/1935 | Hinckley | 273/175 X |
| 2,478,468 | 8/1949 | Drake | 273/175 X |
| 2,991,082 | 7/1961 | Handzlik | 273/168 X |
| 3,486,755 | 12/1969 | Hodge | 273/164 |
| 3,625,518 | 12/1971 | Solheim | 273/175 |
| 3,652,093 | 3/1972 | Reuter | 273/167 J X |
| 3,815,910 | 6/1974 | Raines | 273/167 G X |
| D206,540 | 12/1966 | Mackenzie | 273/164 X |

FOREIGN PATENTS OR APPLICATIONS

| | | | |
|---|---|---|---|
| 1,129,313 | 10/1968 | United Kingdom | 273/80 C |
| 247,116 | 2/1926 | United Kingdom | 273/175 |

*Primary Examiner*—Richard J. Apley
*Attorney, Agent, or Firm*—Duckworth, Hobby, Orman, Allen & Pettis

[57] ABSTRACT

A golf putter apparatus is provided having a putter head with a front driving face having convex, horizontal and vertical curves each approximating ellipses. A putter shaft is attached in the center of the rear of the putter head and a striking point indicator is located on top of the putter head so that striking a golf ball on the driving face of the putter head at the approximate indicated striking point will compensate for minute movements of a golfer's wrist.

5 Claims, 6 Drawing Figures

GOLF PUTTER

BACKGROUND OF THE INVENTION

1. Field of the Invention

The present invention relates to golf putters and especially to a putter directed to compensate for movement of the wrist of a golfer at the moment of impact in his swing.

In the past, studies have been made and theories generated concerning the principles involved in accurately putting a golf ball in which three principles consistently emerge. These principles include the body being maintained still during the putt and having the golf head pass through the ball's position in the direction of the target, and finally, that the distance be met accurately. A great variety of putters have been provided for improving the distribution of weight of the putting head and shaft, as well as correcting the various visual problems in hitting the golf ball in the proper manner. The present putter on the other hand differs in that it addresses itself to the specific problem of compensating for minute degrees of unwanted wrist movement, in than even with such movement the ball will be struck toward the target as long as the entire club head is advanced in that direction. The invention is no substitute for the skill of the golfer, but is designed to recognize the problems by bringing together the anatomical physiology with the physics of golf putting.

A number of prior patents deal with golf clubs having concave or convex surfaces on the striking face, but most of these deal with a convex face or bulge in the woods to prevent hooks and slices by controlling the spin of the golf ball when driving a ball long distances. The principles however used in golf clubs to control the spin is of no benefit in putters in which there is no spin inasmuch as the ball does not leave the ground and is only hit short distances. Typical of the prior patents dealing with surfaces to control spin is U.S. Pat. No. 2395837 for a golf club and method of manufacturing the same; U.S. Pat. No. 1,657,473 for a golf club and U.S. Pat. No. 3,172,667 for a golf club head having a plastic striking face insert bonded to the club head material and method for making same. In addition, prior art golf clubs have taught spherical club heads, such as in U.S. Pat. No. 3,759,527 and U.S. Pat. No. 3,743,297. In U.S. Pat. No. 2,665,909 a cylindrical putter head is provided for hitting a golf ball to provide a ball engaging surface convex in one plane but not in a plane perpendicular to that plane. Finally, U.S. Pat. No. 1,615,038 is a golf club putter having a flat face in its middle portion which then curves backwardly. It has also been suggested to use concave surfaces on clubs, but these have been prohibited under Professional Golf Association rules. Mathematical theory would indicate that the curve upon a striking face of a putter head should be circle to accomplish the intended purpose of compensating for unwanted wrist rotation. However, the application of a circular curve will not adequately address the problem of unwanted wrist movement because anatomical physiology teaches that the wrist does not move in the horizontal or vertical plane as the center of a perfect circle, due to the articulations of the carpal bones. The ligaments binding the wrist, more nearly approximate an ellipse. Therefore, the compensatory curves upon the striking surface of the putter head must be an ellipse. The present invention on the other hand brings together a golf putter having predetermined curvatures on its driving face along with other features which in combination provide compensation for minute degrees of unwanted wrist movement.

SUMMARY OF THE INVENTION

A golf club putter for compensating for minute degrees of unwanted wrist movement is provided having a putter head, having a front driving face along with a rear, top and bottom sides. The driving face has a convex horizontal curve approximating an ellipse and may have the convex vertical curve approximating a second ellipse. Each elliptical surface may have extended focal lengths. A shaft is attached to the rear side of the putter head directly behind the striking point of the putter face, and the striking point indicator is located on the top side of the putter head to indicate the point for striking the golf ball so that a golf ball may be driven on the driving face of the putter head at the approximate indicated striking point and will compensate for slight wrist movement on the user at the moment of impact with a golf ball.

BRIEF DESCRIPTION OF THE DRAWINGS

Other objects, features and advantages of the present invention will be apparent from a written description of the drawings in which.

DESCRIPTION OF THE PREFERRED EMBODIMENT

Figure 2:
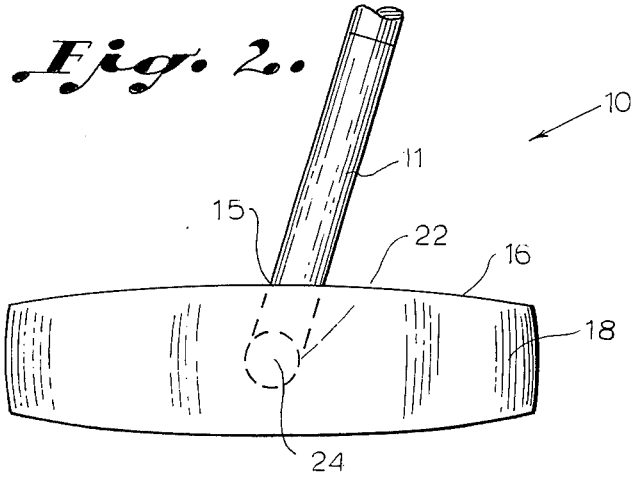
FIG. 2 is a front plan view of the embodiment of FIG. 1.

Referring to the drawings, a golf club putter 10 is illustrated having a shaft 11 with a handle 12 on one end thereof attached to a putter head 13 at the opposite end thereof. The shaft has an insertion curve 14 and attaches to the rear side 15 of putter head 13. Putter head 13 also has a top or superior surface 16 and a bottom surface 17 along with a striking or driving face 18 on the front thereof and two end sides 20. The striking face 18 has an elliptical curve in the horizontal plane and may also have a similar elliptical curve in the vertical plane thereby providing a complex curved surface having two intersecting elliptical surfaces. It should be understood that an ellipse is defined as the locus of a point such that the sum of its distances from two fixed points is constant. Thus, if the convex curve of this type is moved across the front horizontal plane of the golf putter head driving face, it will generate a curve in accordance with the present invention. If a second such curve is moved across in a vertical direction a similar curve will be placed on the surface in a perpendicular direction.

Figure 1:
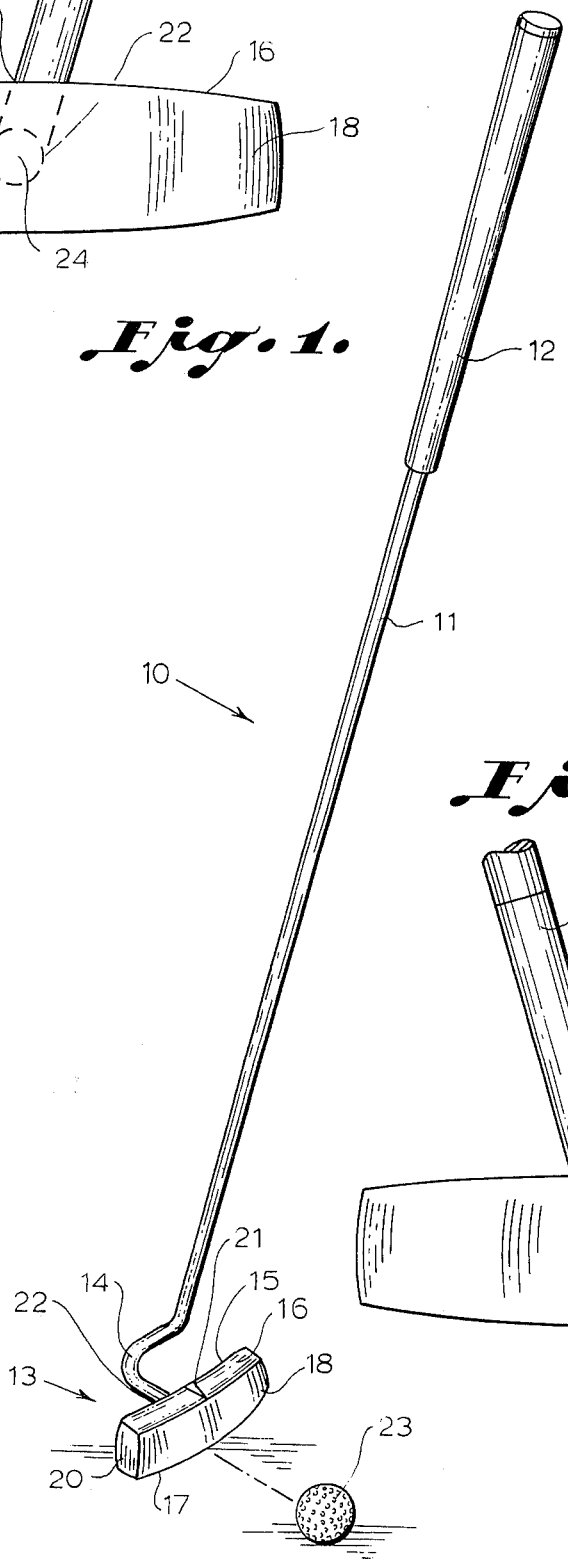
FIG. 1 is a perspective view of a putter according to the present invention.
Figure 4:
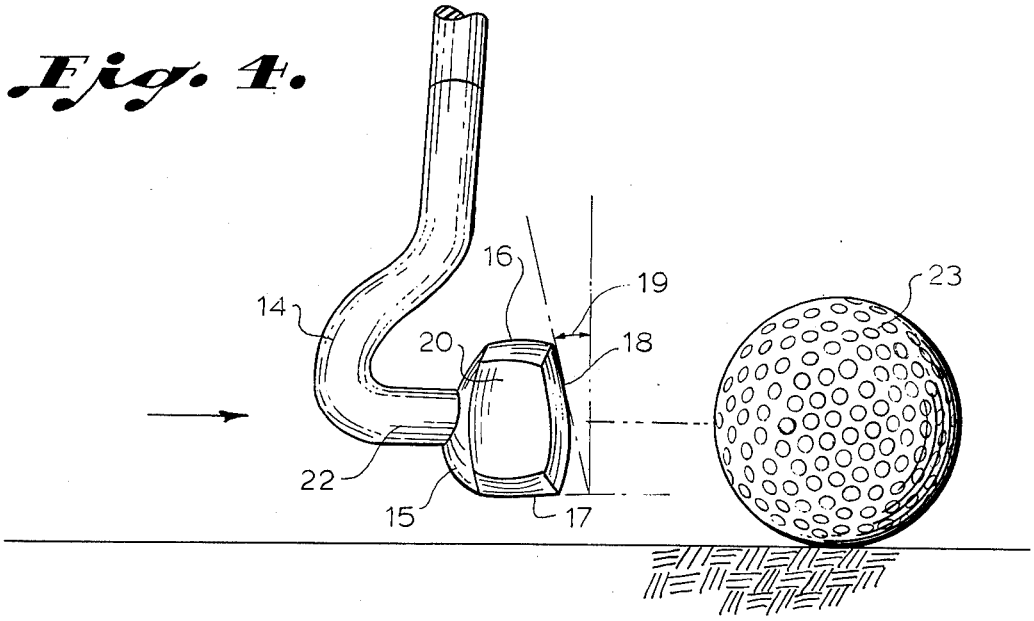
FIG. 4 is a side plan view of the putter of FIGS. 1 through 3.

The superior surface 15 of the putter head 13 has a triangular striking point indicator 21 marked in the center of the top 16 which is generally in line with the insertion curve 14 attaching portion 22 of the shaft 11 which is attached to the putter head 13 at the approximate midpoint of the horizontal axis of the two curves of the striking face 18. The purpose of the elliptical curves is to compensate for minute degrees of unwanted wrist movement which is the result of the golfer's tendency to pronate or supinate the wrist at a slight degree at the moment of impact swing thereby pulling the resultant trajectory of the ball to the left or pushing it to the right in the case of a right-handed golfer. This curve works in connection with the insertion curve 14 which is a semicircular curve originating in the direction away from the club head and traveling in a plane demarcated by the vertical axis of the shaft and terminating with insertion into the putter head rear surface 15 opposite the striking surface at a point defined as the midpoint of the club head's vertical and horizontal axis. The inscribed triangular strike-point indicator 21 which may be etched into the superior surface 16 of the putter head 13 with the apex of the triangle pointing towards the driving face 18 at the same axis of insertion of the shaft portion 22 so as to indicate to the golfer the level of maximum power transmission from shaft to club head and thereby indicating optimum direction of swing of the putter head through the ball position to the target. In FIGS. 1, 4 and 6 a golf ball 23 is indicated being driven by the putter 10 with FIG. 5 indicating the putter head driving the ball 23 at a slight off-axis position. FIG. 2 more clearly indicates the alignment of the striking point indicator 15 with the center axis 24 of the shaft 11 connecting portion 22.

Figure 3:
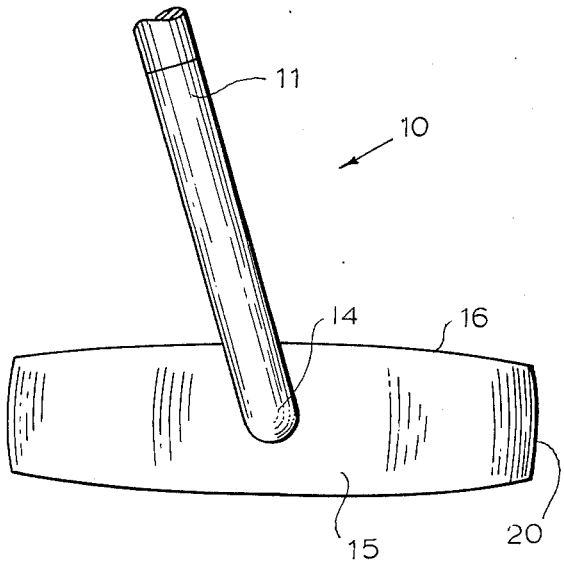
FIG. 3 is a rear plan view of the putter in accordance of FIGS. 1 and 2.
Figure 5:
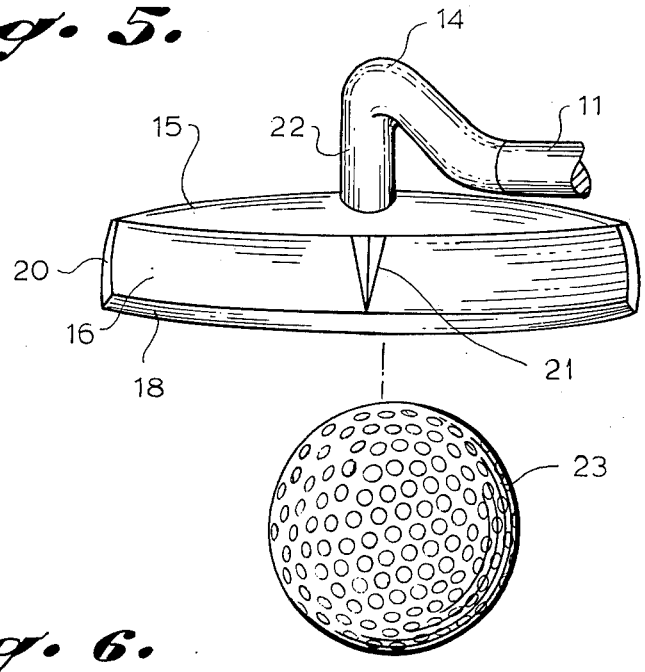
FIG. 5 is a top plan view of the embodiment of FIGS. 1 through 4.
Figure 6:
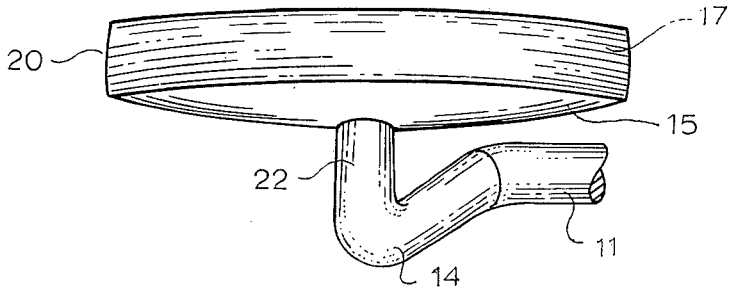
FIG. 6 is a bottom plan view.

FIG. 3 illustrates the back of the putter and FIGS. 4 and 5 more clearly illustrate the complex curve of the driving face 18. FIG. 4 clearly illustrating the vertical convex curvature and FIG. 5 illustrating the horizontal curvature. FIG. 4 has the ball 23 rolling on the earth surface 25 to indicate the operation relative to the vertical curve while FIG. 5 illustrates the striking of the horizontal curve.

One example of the present invention might include a putter having a total length horizontal plane of the putter head (the major axis) of 87 mm, and a length of the semiminor axis in the same plane of 5 mm; the semiminor axis being perpendicular to and extending from the horizontal plane to the curve itself at its midpoint. The focus can be 43.21 mm., with the curve having eccentricity of 0.99. In the vertical plane of the putter head striking surface there is a perpendicular intersecting elliptical curve with the following properties, a total length vertical plane of 26.1 mm., a semiminor axis in the same plane of 1.5 mm. and a focus of 13.01 mm. Eccentricity is identical to the horizontal curve (0.99).

A loft angle 19 as illustrated in FIG. 1 may be 6 degrees. In a conventional putter with the striking surface being a flat plane, the vertical cross section of which demonstrates a straight line, the angle of loft is defined as that formed by the face of the striking surface with the vertical when the base surface of the putter head is parallel to the horizontal. In the present putter, with striking surface being a curved plane, the perpendicular cross section of which demonstrates an ellipse, the angle of loft is the degree of rotation of the major axis from the vertical when the base of the putter head is parallel to the horizontal. This is demonstrated by a tangent to the curve at the point of its intersection with the semiminor axis. This tangent is of course perpendicular to the semiminor axis and therefore parallel to the major axis.

The present golf putter can be made of any material desired, but typically, standard steel or aluminum shafts could be utilized with the putter head made of brass, bronze, steel or any other material, but which would normally be a cast metal. However, any material desired can be utilizied without departing from the spirit and scope of the invention. Accordingly, the present invention is not to be construed as limited to the forms disclosed herein since these are to be regarded as illustrative rather than restrictive.

I claim:

1. A golf putter comprising:

a putter head having a front driving face, and rear, top and bottom sides, said driving face having a substantially convex horizontal elliptical curve of extended focal length;

said putter head driving face having a substantially convex vertical elliptical curve thereby forming a face of intersecting elliptical surfaces;

a shaft attached to the rear side of said putter head behind said driving face; and a striking point indicator located on the top side of said putter head whereby striking a golf ball on the driving face of said putter head at the approximate indicator striking point will compensate for a slight wrist movement of the user.

2. A golf putter in accordance with claim 1 in which the shaft has a hooked curve on one end thereof with a protruding straight portion adjacent said hooked curved attached to the approximate center of the rear side of said putter head.

3. A golf putter in accordance with claim 2 in which the elongated axis of the protruding straight portion of said shaft entering the rear of said putter head is parallel with the striking point indicator on the top side of said putter head.

4. A golf putter in accordance with claim 3 in which said striking point indicator is a pointer etched into the top of the putter head.

5. A golf putter in accordance with claim 1 in which the angle of loft of the driving face of said putter head is approximately 6°.

* * * * *